United States Patent [19]

Sherwood

[11] Patent Number: 4,637,398

[45] Date of Patent: Jan. 20, 1987

[54] MASTECTOMY BRASSIERE

[76] Inventor: Janice K. Sherwood, 2 Grove Isle Dr., Coconut Grove, Fla. 33133

[21] Appl. No.: 786,668

[22] Filed: Oct. 11, 1985

[51] Int. Cl.[4] ..... A41C 3/10

[52] U.S. Cl. ..... 128/478

[58] Field of Search ..... 128/478, 479, 482, 515, 128/512, 425; 623/7

[56] References Cited

U.S. PATENT DOCUMENTS 2,661,470 12/1953 Day ..... 128/478

4,261,366 4/1981 Lamborn ..... 128/478

FOREIGN PATENT DOCUMENTS 479290 6/1968 Switzerland ..... 128/479

*Primary Examiner*—Doris L. Troutman

*Attorney, Agent, or Firm*—Bauer & Amer

[57] ABSTRACT

A mastectomy garment includes an underbra, a breast prosthesis, and an outerbra. The underbra is of lightweight garment foundation material having a cup for the normal breast and a flat band portion for the removed breast, enabling a firm, flat-fitting garment over the remaining chest surface of the removed breast. The prosthesis or false breast itself is removably adhered to the outer surface of the flat, binding portion. The outerbra such as a conventional off-the-shelf brassiere is placed over the underbra and the adhering prosthesis, the underbra and outerbra are then secured together to prevent relative movement between them.

9 Claims, 8 Drawing Figures

MASTECTOMY BRASSIERE

BACKGROUND OF THE INVENTION

The present invention relates to a prosthetic brassiere garment and in particular to an improved prosthetic brassiere garment for use by a person having a mastectomy where one or both breasts have been removed or altered.

Many attempts have been made to enable the patient suffering from a mastectomy to overcome the mental and physical shock associated therewith by attempting to reconstruct her physical being by providing brassieres constructed to provide the appearance of having a pair of complete natural breasts. It has been suggested to provide brassieres which are capable of being stuffed with sanitary pads, absorbing cotton or rubber forms simulating one or both breasts. It has also been suggested to provide brassieres with built in pockets in which such filling material can be located. Plastic forms filled with liquid have also been recommended as have inflatable plastic balloons. Reference may be made to U.S. Pat. Nos. 2,637,851; 3,447,538; 3,489,153; 4,363,144; and 4,185,332 for examples of such attempts. These references being illustrative further of the problems involved in providing mastectomy prosthetic brassieres of only limited success in solving such problems.

Current mastectomy prosthesis have been designed for an obsolete function, namely to provide pseudo-architecturally simulated breast structure. They are generally heavy, uncomfortable, and expensive, as well as cosmetically less than optimum. Another group of prosthesis currently available, make use of pre-molded or pre-shaped plastics and although not heavy or expensive, are similarly less than desirable for aesthetic purposes, since they are generally mass produced and shaped in conformity with standard figures, rather than being shaped to conform to that of the woman wearing the garment.

For all such classes of prosthesis, the ability to wear aesthetically pleasing outer garments is virtually impossible, and outer garments such as high fashion dress wear, lower cut necklines, or the like cannot be worn and have been unusable until the present invention.

In particular, all of the prosthesis known to date have a tendency to pull or fall away from the chest wall as the woman moves or shifts position, or as the woman bends or even leans slightly forward. Another problem of the prior art arises from the fact that the prosthesis normally extend over and visually beyond the normal bra line.

Still another problem existing with the current or prior known prosthesis is the fact that because of the expense incurred in constructing such bras, they are not readily adaptable to changing bra styles, and the woman having had a mastectomy has relatively little choice in the form of the brassiere she can wear. This is particularly irksome to women who before having had the mastectomy have been accumstomed to having virtual infinite choice in bra styles and shapes, so as to go along with both her mood as well as the type of outer garment being worn.

It is an object of the present invention to overcome the problems heretofore mentioned and to provide a prosthesis which will be able to provide the woman with a large range of shapes and styles. It is a further object of the present invention to provide a mastectomy prosthesis which fits both comfortably, accurately and will not shift in position or part or fall away from the chest wall.

The foregoing objects and advantages together with numerous others will be apparent from the foregoing disclosure.

SUMMARY OF THE INVENTION

According to the present invention, a mastectomy garment is provided comprising in combination an underbra, a breast prosthesis, and an outerbra. The underbra is of lightweight garment foundation material having a cup for the normal breast, should one remain, and a substantially flat band portion for the removed breast, enabling a proper, accurate and firm, flat-fitting garment over the remaining chest surface of the removed breast so as to obviate any visual separation between the same and the chest of the wearer. The prosthesis or false breast itself is formed in the desired shape of substantial mirror image to the remaining breast and is removably adhered to the outer surface of the flat binding portion of the underbra by and convenient means, such as snaps, velcro or temporary adhesive material. The outerbra may be a conventional off-the-shelf brassiere of any style and/or fashion that the wearer wishes. It is then placed over the underbra and the adhering prosthesis. The underbra may thereafter be secured to the outerbra at any position and conveniently where the outerbra is joined to the shoulder straps so that the combination of underbra, prosthesis and outerbra are supported solely by a pair of singular shoulder straps and form a unitary undergarment that has the appearance, lightness of weight and feel of a modern bra. The ability to select a modern off-the-shelf bra, no longer limits or restricts the wearer to the use of stereotyped surgically appearing bras of one matronly appearing style.

By providing an underbra which conforms accurately and surely to the surface of the chest, at the point where the breast has been removed, and by placing the prosthesis and the outer brassiere thereover, the unitary garment prosthesis of the present invention maintains constant contact with the chest wall thereby obviating telltale separation therefrom no matter what position the woman assumes or movements she performs.

The underbra may be made of lightweight elastic material such as spandex and provided with adjustable shoulder straps and a rear or back encompassing strap with hook devices so as to be initially fit onto the woman properly. Preferably the underbra is custom-fit and initially put on by the woman to assure proper adjustment of the chest fitting band. Once the outerbra is put on, the straps and rear hooks are removed and the underbra is directly fastened or secured to the outerbra.

By separating the function of the underbra or undergarment (which provides a firmer unmovable garment next to the skin) from that of the prosthesis (breast shape), as well as from the outerbra (cosmetic appearance), the underbra can be more easily fit to the woman, and the prosthesis more carefully formed precisely to the desired shape. Similarly, by removing the decorative function of the outerbra from that of the prosthesis and the inner fitting underbra garment, more variety and decorativeness can be obtained in the outerbra garment without sacrifice of shape and appearance. Lastly, by combining all three into a single, unitary structure after their fitting, and having a single visible shoulder strap, and rear or back encompassing strap the finished presentation of the unitarily-joined prosthetic brassieres can be both satisfying and aesthetic, as well as functional and as singularly appearing as conventional non-prosthetic bras.

Full details of the present invention are set forth in the following description of the preferred embodiment and are illustrated in the accompanying drawings.

DESCRIPTION OF THE INVENTION

Figures 1, 6, 7, 8:
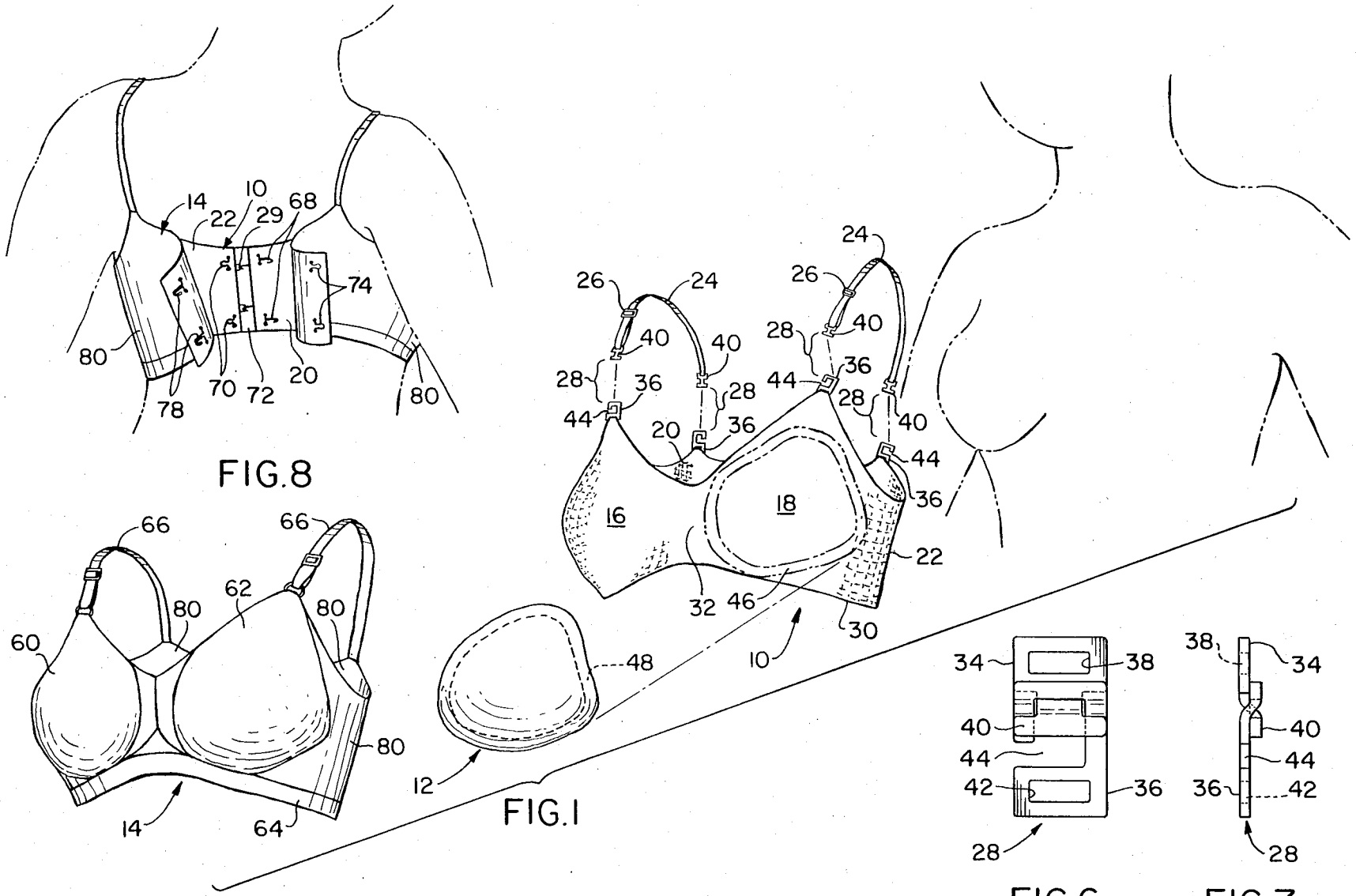
FIG. 1 is an exploded perspective view showing the underbra, breast prosthesis and overbra forming the prosthetic brassiere assembly of the present invention.
FIG. 6 is a frontal view of the hook means employed to attach the shoulder straps to the underbra, and in part later to attach the underbra to the outerbra.
FIG. 7 is a side view of the hook means of FIG. 6.
FIG. 8 is a rear view of the prosthesis device.

As seen from an overall view of the FIG. 1, the prosthetic brassiere of the present invention comprises three basic components, namely, a base garment or underbra 10, an artificial breast pad 12 and a decorative outerbra 14.

Specifically, the base garment or underbra 10, although appearing to conform closely in most respects to a regular brassiere, i.e. having right and left chest sections or portions 16 and 18, and side or underarm rear encompassing strap panels 20 and 22 viewed from the wearer, is designed not to function to provide an architectural foundation structure or to have uplift capabilities. The underbra 10 is provided with a pair of shoulder straps 24, provided with a length adjustment buckle 26, and connecting hooks generally depicted by numeral 28 enabling the straps to be fully detached from the garment in a manner and for a purpose to be described. The side panels 20 and 22 are connected in back of the wearer by conventional means, such as small wire hooks and loops 29, as seen in FIG. 8. Since such closures 29 are common, they are not fully described or illustrated in detail.

As in a conventional brassiere the underbra 10 has a peripheral binding 30, and a bridging section 32 between the right and left chest sections, that is preferably made of slightly expandable or resilient material, such as spandex, nylon or the like so that when placed on the patient's torso will have a fully conforming fit as will be explained in greater detail later. The underbra 10, as shown in the Figures is made for a patient having only one breast removed, and therefore for illustration the right chest section 16 is shown completely formed with a non-structural cup while the left chest section 18 is flat. Should a garment be required for a patient having both breasts removed, then the illustrated cup, here the right section would appear identical to the flat or left chest section 18.

Figure 2:
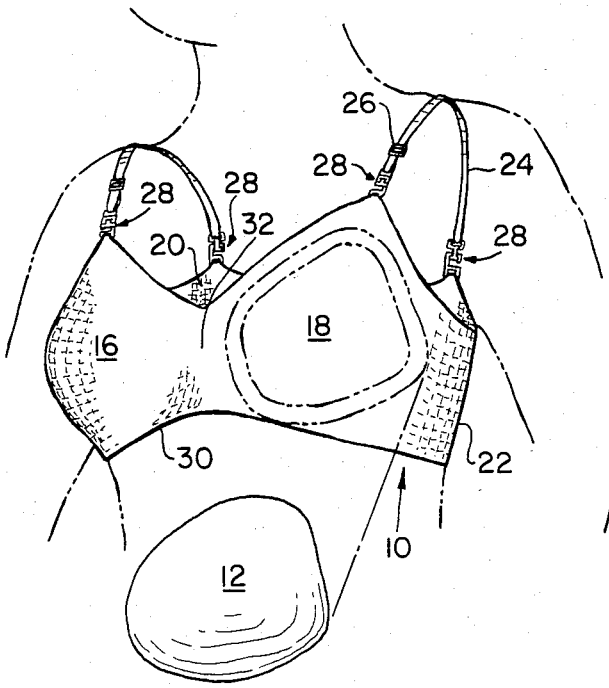
FIG. 2 is a front elevational view showing the underbra garment fitted in place on the wearer awaiting placement of the breast prosthesis thereon.
Figure 3:
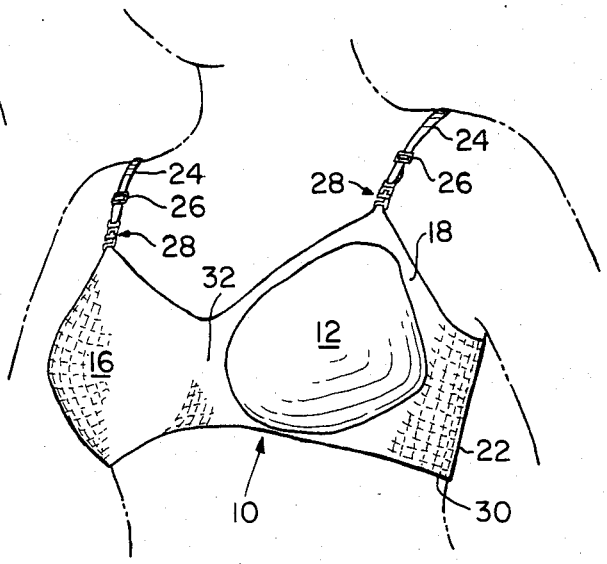
FIG. 3 is a view similar to that of FIG. 2 showing the prosthesis fitted on and attached to the underbra.

The base underbra 10 is custom-built and custom formed to the contours of the torso of the patient. In sizing the underbra 10 the flat portion 18 covering the chest portion from which the breast has been removed, is designed in size, so as to lie fitting flat in engagement against the chest wall as seen in FIG. 2. The initally provided shoulder straps 24 are respectively connected at one end to the apexes of the right and left chest sections 16 and 18 and at their other end to the corresponding point on the rear edge of the side and rear strap panels 20 and 22 that extend about and encompass the back of the wearer to obtain the most comfortable fit with the underbra closely lying and engag:ng against the patient's body. The shoulder straps 24 are secured only during the initial phase of fitting and/or adjustment of the underbra 10 to the wearer. Once such fitting and sizing has been accomplished, the shoulder straps 24 respectively are removed at the hook connections 28, and the underbra 10 is then held snugly, attached directly to the wearer and held by the back straps 20 and 22 and outerbra 14 in a manner to be described.

As seen in FIGS. 6 and 7, the connecting hooks 28 are formed of two separable elements 34 and 36 attached respectively to the shoulder straps 24 and to the underbra 10. The element 34 which is attached to the shoulder strap 24 comprises a loop section 38 about which the end of the strap 24 is folded and sewn. It has a downwardly extending T-shaped male section 40. The element 36 which is attached to the underbra garment 10 itself, comprises a loop section 42, about which the garment 10 itself is folded and sewn. A reverse C-shaped female section 44, extends upward therefrom. As seen in FIGS. 6 and 7, the T-shaped male member 40 and the female C-shaped section 44 are offset from the plane of the loop sections 38 and 42 respectively and cooperate to detachably interengage by moving the extension 40 through the opening 44, either to engage them as shown in FIG. 6 or to disengage them to separate the straps from the body of the underbra 10 as shown in FIG. 1. When the straps 24 are removed from the underbra 10, the underbra is left with only the female C-shaped elements 44.

Figure 5:
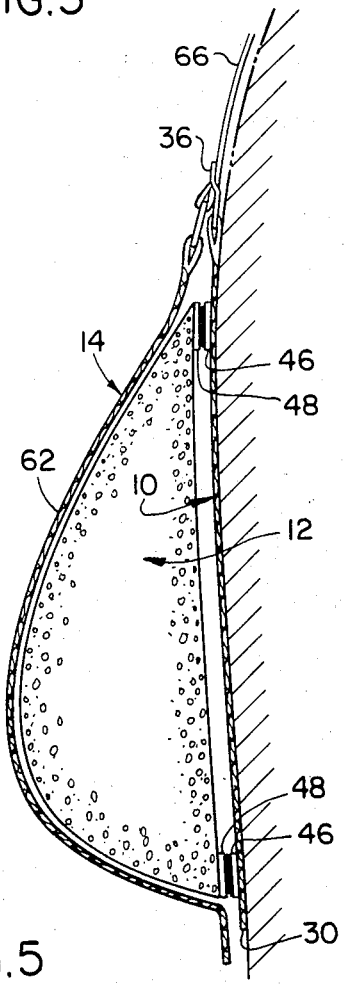
FIG. 5 is a cross-sectional view taken along lines 5—5 of FIG. 4.

The front face of the flat breast portion or section 18 of the underbra 10 has secured to it the artificial prosthetic breast pad 12. The prosthetic breast pad 12 is preferably molded foam plastic sponge rubber or the like. The pad 12 may be covered with fabric or left as molded. The pad is shaped as desired for the wearer, although it is preferable to match it as close as possible to the natural contours of the body and the remaining natural breast. The artificial breast pad 12 may be secured to the front of the portion 18 of the underbra 10 by hook means or snap means or by other fastening or attachment means. In practice, it is preferred that the underbra 10 be made with a ring of velcro 46 attached to its outer surface as seen in FIGS. 1 and 5. The artificial or prosthetic breast pad 12 is made with cooperating velcro material 48 on its back wall. In this manner the pad 12 may be easily attached to and removable from the underbra 10 without the need for any interfering or uncomfortable feeling normally obtained with the use of snaps or metal fasteners.

The outer, decorative bra 14 is preferably a commercially available bra since its purpose is indeed to be decorative, modernly attractive and cosmetic. Its purpose is also to provide a functional uplift and foundation support for the remaining and full breast of the wearer, as well as to provide the architectural support for the prosthetic or pseudo-breast adhered to the undergarment 10. Since, in fact, this is the specific function of the commercially available bra, they need be manufactured no differently than those presently manufactured and can be in any of the current or future available models.

Figure 4:
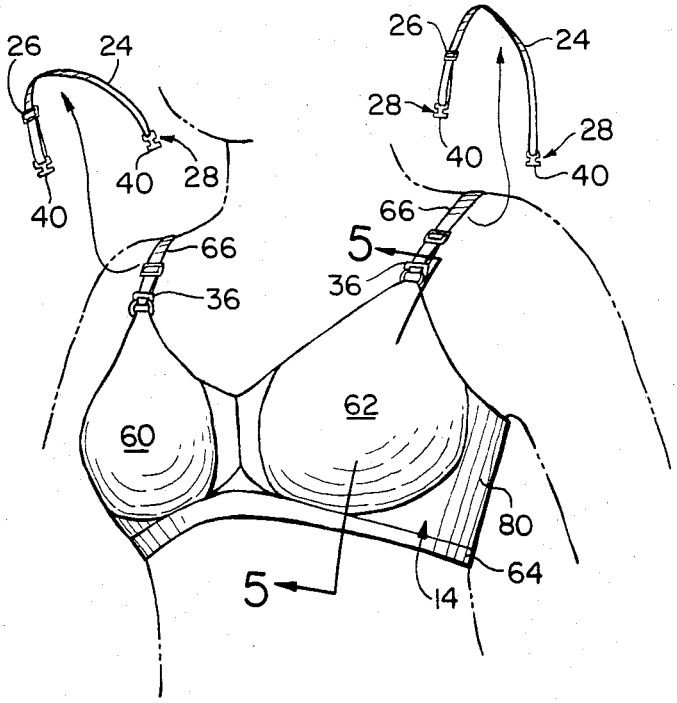
FIG. 4 is still another similar to that of FIG. 3 view showing the outerbra placed over the prosthesis provided, completing the unitary structure as worn by the user.

The outer, decorative bra 14 is provided with a pair of breast cups 60 and 62, functional bindings 64, and fully secured shoulder straps 66. When it is placed over the underbra 10 after the artificial prosthetic pad 12 is adhered thereto, the straps 24 from the underbra 10 are removed and the female C-shaped hook sections 36 that remain on the underbra 10 are secured to the outerbra 14. This is done by moving the sections 36 to cause their C-shapes 44 to receive the straps 66 therein through the openings thereof. When the straps are received within the confines of the C-shaped openings 44, the sections are released to permit the straps to assume the partially enclosed position which the T-shaped extension 40 previously occupied. This is illustrated in FIGS. 4 and 5. Thus, the underbra 10 and the outerbra 14 are initially fixed together into a single unitary bra structure with the prosthetic pad 12 snugly and unmovably sandwiched therebetween and forming a unitary part thereof.

To insure that the underbra 10 and outerbra 14 form the unitary brassiere combination and that the two do not move relative to each other, the back bands or side straps 20 and 22 of the underbra, can be provided with means, such as a set of hooks 68 and a set of loops 70, that are positioned close to the abutting ends 72 in the manner shown in FIG. 8. The hooks 68 are placed in opposition to the loops 74 located on the outerbra, while the loops 70 on the underbra are located in opposition to the hooks 78 located on the outerbra. In this manner, the outerbra 14 can be strapped by straps 20 and 22 about the back of the wearer by being directly attached to the back of the underbra 10, both bras are restrained and held against relative movement therebetween.

It is within the contemplation of the invention that the rear or back encompassing straps 20 and 22 may be removed once the unitary combination of the two brassieres 10 and 14 is completed. This may be done by providing the straps 20 and 22 with removable connections similar to or the same as the connections 28 discussed hereinbefore. In such case, parts of the straps 20 and 22 may be removed enabling the underbra 10 to be unitarily joined to and with the outerbra 14 whose rear or back straps 80 will attach to each other behind the wearer in a conventional manner as by the hooks and eyelets 29 to maintain the combined bras to the wearer. This will prevent separation of the prosthetic pad 12 from the wearer even during rigorous movements to effect a natural appearance at all times.

Once the garments 10 and 14 are attached together, the prosthetic pad 12 becomes sandwiched between the underbra and the overbra which then become relatively immovable. The underbra band portion 18 maintains its form fitting shape against the chest wall of the patient, while the outerbra serves the function of maintaining the uplift and the foundation functions of the normal bra. The undergarment, being light in weight and of simple thin structure adds no significant additional weight to the normal bra nor does it influence adversely the comfort of the normal bra.

It is apparent from the foregoing that the present invention provides the advantages and the objects enumerated earlier in a prosthetic garment system, which is both attractive and comfortable to the wearer.

Various modifications and changes have been suggested, others will be apparent to those skilled in the art. It is intended, therefore, that the present disclosure be taken as illustrative of the invention and not limiting its scope.

What is claimed is:

1. A singular prosthetic brassiere garment compensating for the loss of a woman's breast consisting of the combination of a separate underbra, a breast prosthesis and an outerbra, the underbra having a band portion to enclose the torso and a supporting cup for the normal breast of the wearer when the wearer has a remaining breast, and a flat portion fitting flat against the chest wall from which a breast has been removed, said prosthesis comprising, a prosthesis pad formed of a desired shape simulating the removed breast and removably adhered to the outer surface of said underbra, said outerbra comprising a conventional brassiere having a pair of breast supporting cups, one of said underbra and outerbra having adjustable strap means, the other of said underbra and outerbra having strap means joined with said adjustable strap means whereby said underbra, prosthetic pad, and outerbra are joined together to form a unitary garment in which said bras are adjustable to be retained fitting against the chest wall of a removed breast and against separation therefrom and to provide the function and produce the appearance of a singular brassiere.

2. The garment according to claim 1, wherein said underbra is formed of resilient material.

3. The garment according to claim 2, wherein said underbra is formed of SPANDEX.

4. The garment according to claim 1, wherein said prosthetic pad is formed of resilient material and said prosthetic pad and said underbra are provided with cooperating means releasably fastening the same together.

5. A prosthetic brassiere for a woman having a breast removed from her body, comprising inner and outer brassiere members, said inner brassiere member comprising at least one band portion having in the area of the natural breast a receiving and supportive breast cup, and being otherwise substantially flat to cover and to lie in close fit with and against the torso of the wearer and the chest wall from which a breast was removed, said band portion including back encompassing strap means to maintain said band portion flat in close fit with the chest wall of the removed breast, said outer brassiere member having a pair of receiving and supporting breast cups and including back encompassing strap means to retain said cups in close fit against the wearer, a prosthetic pad simulating the contour of the removed breast, means to adhere said prosthetic pad to the surface of said band portion and to be covered by the corresponding one of the breast cups of said outer brassiere member to hold the same in close fit against the chest wall of the covered breast to appear as the natural breast of the wearer, and means on said back encompassing strap on at least one of said inner and outer brassiere member to secure said outer and inner brassiere members together, said outer brassiere member compressing said prosthetic pad and inner brassiere member into close fit with the torso of the wearer to prevent separation of said inner brassiere member and prosthetic pad from its close fit with the wearer during movements of the wearer.

6. A prosthetic brassiere comprising inner and outer brassiere members, according to claim 5, including shoulder strap means on said outer brassiere member engaged by said inner brassiere member to support the inner and outer brassiere member on the shoulders of the wearer.

7. A prosthetic brassiere comprising inner and outer brassiere members, according to claim 5, said back strap of said inner brassiere member is removable, and said inner brassiere member includes means attachable to said back strap of said outer brassiere member to form a unitary brassiere.

8. In a prosthetic brassiere having an underbra, a conventional outerbra and a breast simulating prosthetic pad contained therebetween, the improvement wherein said underbra is separate from said overbra and comprises at least one breast portion lying substantially flat against the contour of the wall of the chest of a removed breast of the wearer and a laterally extending band encompassing the body of the wearer to maintain said at least one breast portion substantially flat against the wall of the chest of the removed breast, means for securing said breast simulating prosthetic pad to said at least one breast portion of said underbra separate from said conventional outerbra, and means for removably joining the underbra to the separate conventional outerbra with the breast simulating prosthetic pad contained and compressed therebetween.

9. A method for converting a conventional brassiere having a pair of breast supporting cups, adjustable shoulder straps and adjustable back encompassing straps into a prosthetic brassiere for a woman having one or more breasts removed, comprising the steps of providing a fabric band having shoulder straps, back connecting straps, a first chest portion lying substantially flat against the chest wall from which a breast has been removed and a second chest portion, where the breast has not been removed, having a form for receiving the remaining breast, applying the fabric band to said woman to fit closely about her body, adhering a prosthetic pad simulating the contour of the removed breast to the surface of the second chest portion of the fabric band overlying the chest wall from which a breast has been removed, removing the shoulder straps from at least one of the fabric band and the conventional bra, and thereafter securing the fabric band and the conventional bra together at least at the remaining shoulder straps and back encompassing straps to form a secure unitary singular garment conforming to the woman's natural physique with the prosthetic pad and non-supporting portion of the fabric band filling the corresponding breast supporting cups in the conventional bra.

* * * * *